US005555568A

United States Patent [19]

Yon

[11] Patent Number: 5,555,568

[45] Date of Patent: Sep. 17, 1996

[54] UNDERPANTS FOR MEN HAVING EXTENDABLE SANITARY PORTION

[76] Inventor: In K. Yon, 617-106, Jukong Apt. #124, Sangil-dong, Kangdong-gu, Seoul, Rep. of Korea

[21] Appl. No.: 349,671

[22] Filed: Dec. 5, 1994

[30] Foreign Application Priority Data

Jul. 19, 1994 [KR] Rep. of Korea ..... 1994-17913

[51] Int. Cl.[6] ..... A41B 9/02

[52] U.S. Cl. ..... 2/403; 2/400

[58] Field of Search ..... 2/403, 400, 402, 2/405; 604/385.1, 393, 396, 402

[56] References Cited

U.S. PATENT DOCUMENTS 4,555,245 11/1985 Armbruster ..... 2/403

5,290,270 3/1994 Fisher ..... 2/403

FOREIGN PATENT DOCUMENTS 0619953 10/1994 European Pat. Off. ..... 2/403

0627177 12/1994 European Pat. Off. ..... 2/403

*Primary Examiner*—C. D. Crowder

*Assistant Examiner*—Gloria Hale

*Attorney, Agent, or Firm*—Dilworth & Barrese

[57] ABSTRACT

The present invention relates to underpants for men which comprises a sanitary section so that a penis can be sanitarily treated. A construction in which the sanitary section having a predetermined area is attached to a divided portion of the underpants allows the underpants to be kept sanitary by removing any remaining urine after men urinate.

10 Claims, 1 Drawing Sheet

UNDERPANTS FOR MEN HAVING EXTENDABLE SANITARY PORTION

TECHNICAL FIELD OF THE INVENTION

The present invention relates to underpants for men, and more particularly to underpants for men in which a sanitary section is provided to the middle part of the front.

BACKGROUND OF THE INVENTION

Generally, the underpants for men include a divided portion in the middle of the front, for convenience sake, through which men may pass the penis to urinate. Then, the penis is commonly put back in an original position through the divided portion without any sanitary treatments after urinating. Accordingly, there are drawbacks that it is unsanitary because the rest of urine remains on the underpants, and soiled underpants do not provide a clean external surface.

SUMMARY OF THE INVENTION

To solve the above problem, it is an object of the present invention to provide sanitary underpants for men with a sanitary section positioned in a divided portion of the front.

To accomplish the above objects, this invention provides underpants for men which include a divided portion through which the penis can pass inside and outside. The underpants for men comprises a sanitary section having a predetermined area, one end of which is fixed to one side of the divided portion, in which the sanitary section is free to move inside or outside.

DETAILED DESCRIPTION OF THE PREFERRED EMBODIMENT

A preferred embodiment of the present invention will be described below in more detail with reference to the accompanying drawings.

Figure 1:
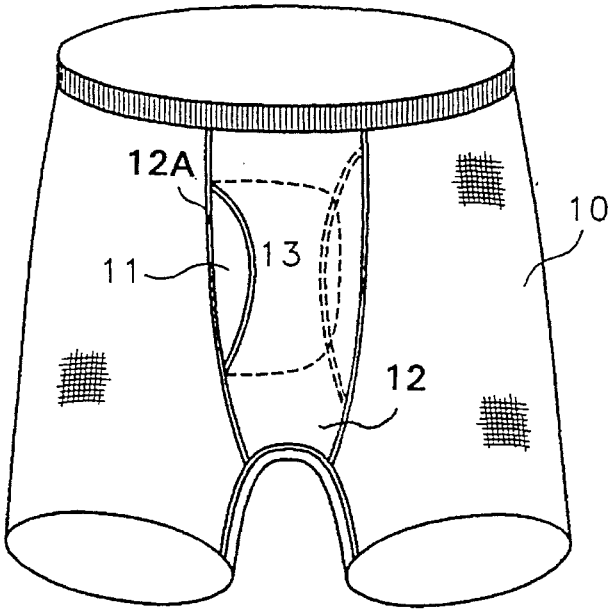
FIG. 1 is a perspective view showing a sanitary section inserted within divided portion in accordance with the present invention.
Figure 2:
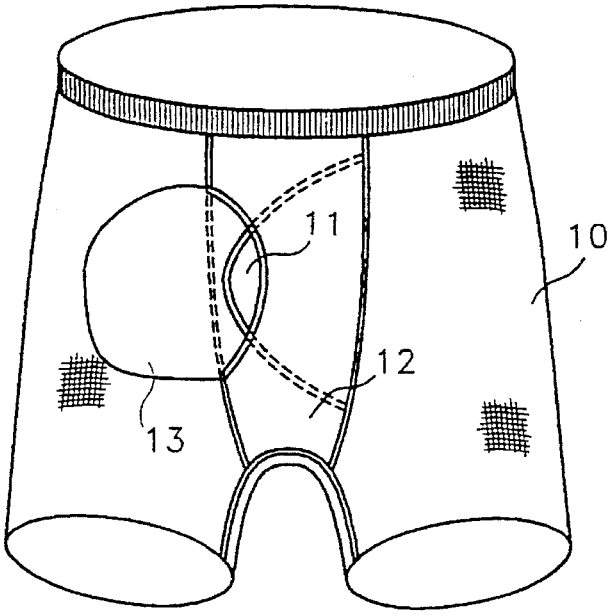
FIG. 2 is a perspective view showing a laid-open sanitary section in accordance with the present invention.

FIG. 1 is a perspective view showing insertion of a sanitary section into the inside of a divided portion. FIG. 2 is a perspective view showing the laid-open sanitary section in accordance with the present invention. The main body 10 of the underpants into which two legs and the user's body is inserted comprises a divided portion 12 which has double walls, the external and internal walls of which are spaced at a predetermined interval so that an opening 11 is formed in the middle of the front of the main body 10 for passing a penis inside and outside. On one side 12*a* of the divided portion 12 one end of a sanitary section 13 is fixed, which has a predetermined area and is positioned freely between the inside and outside of the double walls of the divided portion 12 through the opening 11.

A function of the underpants for men will be further described below. First, when men wear the underpants, the sanitary section 13 is normally positioned between the double walls of the divided portion 12, i.e., at the opening 11, as shown in FIG. 1. When men have a need to urinate, first the sanitary section 13 is taken out as shown in FIG. 2, and then the penis becomes exposed through the opening 11. Next, the penis is covered and cleaned with the sanitary section 13 after finishing urination. Lastly, the penis is placed back to the original position through the opening 11. Accordingly, the sanitary section 13 treats sanitarily any remaining urine on the penis and the sanitary section 13 is replaced between the double walls. Accordingly, this arrangement is very sanitary because the sanitary section 13 does not directly touch the body.

As described above, the underpants for men in accordance with the present invention has an effect of maintaining a sanitary and clean condition external to the body.

What is claimed is:

1. Underpants for men comprising:

a divided portion through which a penis can pass; and a sanitary section having a predetermined area and at least first and second sides, one of which is fixed on an external side of said divided portion such that movement of said sanitary section is allowed for cleaning said penis after urination.

2. Underpants for men as in claim 1, wherein said divided portion includes:

a first wall disposed outside of said divided portion;

a second wall disposed inside of said divided portion; and said first and second walls coupled to form a channel for storing said sanitary section.

3. Underpants for men as in claim 2, wherein said channel allows passage of said penis.

4. Underpants for men as in claim 1, wherein said sanitary section is a cloth.

5. Underpants for men comprising:

a main portion for receiving a man's lower body and legs;

a divided portion disposed in front of said main portion through which a penis can pass; and cleaning means integrally attached to said divided portion and configured for movement between an extended position out of said divided portion and a retrieved position within said divided portion for cleaning said penis after urination.

6. Underpants for men as in claim 5, wherein said divided portion comprises a first wall and a second wall coupled to form a channel for storing said cleaning means.

7. Underpants for men as in claim 6, wherein said channel allows passage of said penis.

8. Underpants for men as in claim 7, wherein said sanitary cleaning means comprises a sanitary section having a predetermined area for cleaning said penis after urination.

9. Underpants for men as in claim 8, wherein said sanitary cleaning section is a cloth.

10. Underpants for men comprising a main portion for receiving a lower body and legs;

a divided portion having a first wall and a second wall such that said first and second walls form a channel for passing a penis; and a cloth integrally attached to said divided portion having a predetermined area and configured for movement between an extended position out of said channel and a retrieved position within said channel for cleaning said penis after urination.

* * * * *